US011530627B2

(12) United States Patent
Pearce et al.

(10) Patent No.: US 11,530,627 B2
(45) Date of Patent: Dec. 20, 2022

(54) ENGINE

(71) Applicant: Gas Expansion Motors Limited, London (GB)

(72) Inventors: Alan Pearce, Exeter (GB); Simon Few, London (GB); Natalie Winter, Exeter (GB)

(73) Assignee: Gas Expansion Motors Limited, London (GB)

( * ) Notice: Subject to any disclaimer, the term of this patent is extended or adjusted under 35 U.S.C. 154(b) by 0 days.

(21) Appl. No.: 17/422,815

(22) PCT Filed: Dec. 18, 2019

(86) PCT No.: PCT/GB2019/053605
§ 371 (c)(1),
(2) Date: Jul. 14, 2021

(87) PCT Pub. No.: WO2020/148515
PCT Pub. Date: Jul. 23, 2020

(65) Prior Publication Data

US 2022/0065136 A1 Mar. 3, 2022

(30) Foreign Application Priority Data

Jan. 14, 2019 (GB) ..... 1900493

(51) Int. Cl.
*F01K 9/02* (2006.01)
*F01K 25/06* (2006.01)
(Continued)

(52) U.S. Cl.
CPC ..... *F01K 9/02* (2013.01); *F01K 25/06* (2013.01); *F01K 25/08* (2013.01); *F01K 9/003* (2013.01); *F05D 2220/31* (2013.01)

(58) Field of Classification Search
CPC ..... F01K 25/06; F01K 21/04; F01B 29/10; F22B 1/1853
See application file for complete search history.

(56) References Cited

U.S. PATENT DOCUMENTS 4,422,297 A 12/1983 Rojey
4,437,312 A 3/1984 Newton
(Continued)

FOREIGN PATENT DOCUMENTS

CN 106 337 701 A 1/2017
EP 2535531 A2 12/2012
(Continued)

OTHER PUBLICATIONS

UKIPO Search Report on GB1900493.6, UK Intellectual Property Office, dated Jul. 15, 2019.
(Continued)

*Primary Examiner* — Shafiq Mian
(74) *Attorney, Agent, or Firm* — Bay State IP, LLC

(57) ABSTRACT

The engine has a thermodynamic expander (21) for extracting work from a vaporised working fluid (22) that is fed to a feed for it. There is also a condenser (26) downstream of the expander for condensing expanded vaporised working fluid that is exhausting from the expander. A liquid tank (28) is downstream from the condenser, and pump means (29) is located downstream from the liquid tank for pumping out condensed working fluid (38). Further, there is a means for heating (50) and at least partially vaporising working fluid pumped to it from the pump and feeding the heated working fluid to the expander. The heating means itself has at least one inlet for the working fluid pumped to it, and at least one output from which the working fluid is fed to the expander.

16 Claims, 8 Drawing Sheets

(51) Int. Cl.
*F01K 25/08* (2006.01)
*F01K 9/00* (2006.01)

(56) References Cited

U.S. PATENT DOCUMENTS 4,448,025 A 5/1984 Oda
6,263,675 B1 7/2001 Hansen et al.
8,667,797 B2 3/2014 Woodland
8,925,320 B1 1/2015 Kalina
10,787,936 B2 9/2020 Pearce
2009/0038307 A1 2/2009 Smith
2010/0034684 A1 2/2010 Ast et al.
2011/0048009 A1 3/2011 Smith
2011/0308253 A1* 12/2011 Ritter ..... F22B 1/1807 60/661
2012/0006024 A1 1/2012 Hays et al.
2012/0048519 A1* 3/2012 Gruss ..... F28D 15/0266 29/890.032
2012/0279220 A1 11/2012 Palmer
2012/0312021 A1* 12/2012 Tsuboi ..... F01K 13/02 60/692
2013/0074497 A1* 3/2013 Mori ..... F01N 5/02 60/618
2013/0241204 A1 9/2013 Brookman
2013/0263598 A1* 10/2013 Almbauer ..... F01K 15/00 60/645
2013/0340434 A1 12/2013 Palmer
2014/0041387 A1* 2/2014 Benson ..... F25B 7/00 60/676
2015/0000260 A1 1/2015 Burrow
2016/0312096 A1 10/2016 Bulinksi et al.
2017/0138223 A1 5/2017 Kontomaris

FOREIGN PATENT DOCUMENTS

GB 2528522 A 1/2016
JP H03 15607 A 1/1991
WO 2014/035441 A1 3/2014

OTHER PUBLICATIONS

International Search Report, European Patent Office, dated May 6, 2020.
Written Opinion of International Searching Authority, European Patent Office, dated May 6, 2020.
International Preliminary Report on Patentability, European Patent Office, dated Apr. 15, 2021.

* cited by examiner

ENGINE

CROSS REFERENCE TO RELATED APPLICATION

This application is for entry into the U.S. National Phase under § 371 for International Application No. PCT/GB2019/053605 having an international filing date of Dec. 18, 2019 and from which priority is claimed under all applicable sections of Title 35 of the United States Code including, but not limited to, Sections 120, 363, and 365 (c), and which in turn claims priority under 35 USC 119 to Great Britain Patent Application No. 1900493.6 filed on Jan. 14, 2019.

The present invention relates to a thermodynamic engine and in particular an externally heated thermodynamic engine having a closed working-fluid circuit.

An organic Rankine cycle engine comprises:

- a thermodynamic expander for extracting work from vaporised organic working fluid fed to a feed for it,
- a condenser downstream of the expander for condensing expanded vaporised working fluid exhausting from the expander,
- a liquid tank downstream from the condenser,
- a pump downstream from the liquid tank for pumping out condensed working fluid from it and
- a heater for vaporising working fluid pumped to it from the pump and feeding the vaporised working fluid to the expander,
  - the heater having an inlet for working fluid pumped to it and an output from which the working fluid is fed to the expander.

In our British Patent No. GB2528522B we have described and claimed:

A thermodynamic engine comprising:

- a thermodynamic expander for expanding a working fluid combined with a second fluid;
- a separator connected to an exhaust of the expander for separating second fluid from the working fluid;
- means for passing the second fluid to
  - a heater therefor and thence to
  - a vaporising region;
- a condenser for condensing the working fluid from gaseous form to a volatile liquid form; and
- means for passing the condensed working fluid in liquid form to the vaporising region for contact with the reheated second fluid for volatising the working fluid for its work producing expansion in the expander.

The abstract of U.S. Patent Application No. 2012/279,220 is as follows:

A method (400, 1100) and apparatus (500, 1200) for producing work from heat includes a boiler (510) which is configured for heating a pressurized flow of a first working fluid (F1) to form of a first vapor. A compressor (502) compresses a second working fluid (F2) in the form of a second vapor. A mixing chamber (504) receives the first and second vapor and transfers thermal energy directly from the first vapor to the second vapor. The thermal energy that is transferred from the first vapor to the second vapor will generally include at least a portion of a latent heat of vaporization of the first working fluid. An expander (506) is arranged to expand a mixture of the first and second vapor received from the mixing chamber, thereby performing useful work after or during the transferring operation. The process is closed and enables recirculation and therefore recycling of thermal energy that is normally unused in conventional cycle approaches.

The object of the present invention is to provide an improved thermodynamic engine.

According to the invention there is provided an externally heated thermodynamic engine having a closed working-fluid circuit, the engine comprising:

- a thermodynamic expander for extracting work from vaporised working fluid fed to a feed for it,
- a condenser downstream of the expander for condensing expanded vaporised working fluid exhausting from the expander,
- a liquid tank downstream from the condenser,
- pump means downstream from the liquid tank for pumping out condensed working fluid from it and
- means for heating with external heat and at least partially vaporising working fluid pumped to it from the pump means and feeding the heated working fluid to the expander,
  - the heating means having at least one inlet for working fluid pumped to it and at least one output from which the working fluid is fed to the expander;

wherein:

- the engine is adapted and arranged for operation with a working fluid including at least two different boiling point constituent fluids and
- the pump means is adapted to pump from the liquid tank to the heating means both the different boiling point constituent fluids in a determined ratio as liquids, whereby, in use, on feeding of the working fluid to the expander in at least partially vaporised state:

- vapour and/or liquid of the higher boiling point liquid releases energy in the expander to vapour of the lower boiling point constituent fluid for production of work in the expander.

Normally, in operation of the engine, the first, lower boiling point constituent fluid will be fully vaporised, from heating in the heating means as opposed to by the higher boiling point constituent as in our GB2528522B, both on feed into the expander and exhaust from it. The second, higher boiling point constituent fluid will be either liquid or vaporised on feed into the expander and liquid on exhaust from it. During passage through the expander, the second fluid will transfer heat energy to the first either without phase change either as a result of retaining its temperature as the first fluid cools on expansion or with phase change of the second fluid from vapour to liquid as well. This latter mechanism, i.e. release of latent heat of condensation, has potential to release much heat energy at a substantially constant temperature to the first working fluid constituent and markedly improve efficiency with respect to the Organic Rankine Cycle engine. Please note that at the time of this application experiments to quantify the improvement in efficiency obtained have not yet been possible.

In an engine for the different boiling point constituent fluids, which are miscible as liquids and pumped to the heating means in proportion to their constituent proportions in the engine at the determined ratio, the pump can be a single pump arranged:

- to draw from a single outlet from the liquid tank, and
- to pump to a single inlet to the heating means.

In an engine for the different boiling point constituent fluids which are immiscible as liquids, the pump can be a single pump arranged:

- to pump to one or more inlets to the heating means, and
- to draw from two outlets from the liquid tank or two respective liquid tanks:
  - the outlets or lines from them to the pump having respective throttles, the throttles being such that the different boiling point constituent fluids are pumped as liquids in proportion to the determined ratio.

Again, in another engine for the different boiling point constituent fluids which are immiscible as liquids the pump can be a two-chamber pump or a pair of pumps arranged:

to pump to one or more inlets to the heating means, and to draw from two outlets from the liquid tank or two respective liquid tanks:

the outlets or lines from them to the pump, or lines from the pumps to the or each inlet, or each inlet where two are provided having respective throttles, the throttles being such that the different boiling point constituent fluids are pumped as liquids in proportion to the determined ratio.

In either such engine, the throttles can be fixed for fixing the determined ratio;

or the throttles can be adjustable for adjusting the determined ratio.

In yet another engine for the different boiling point constituent fluids, which are immiscible as liquids, the pump can be a two-chamber pump, or a pair of pumps arranged:

to pump to one or more inlets to the heating means, to draw from two outlets from the liquid tank or two respective liquid tanks, and to pump with positive displacement in proportion to the determined ratio.

In these engines, where the different boiling point constituent fluids, which are immiscible as liquids, can be passed through the condenser together with only the lower boiling point constituent fluid being condensed. They are passed to a single tank having the two outlets for the liquids of both fluids. These being immiscible, will form separate layers in the liquid tank in accordance with their density. The two outlets are arranged at different levels in the liquid tanks to enable the pump to draw the different boiling point constituent fluids from the tank via the respective outlets.

A separator can be provided upstream of the condenser. Typically, this will be a cyclone separator. It separates the higher boiling point constituent fluid, as a liquid, from the vapour form lower boiling fluid. A separate liquid tank for the separated liquid can be provided. The two respective liquid tanks have the two outlets in the to instance of these engines.

It is envisaged that the separated and condensed liquids could be passed to the same tank separately, and then be withdrawn via two outlets at different levels in accordance with their densities as in an engine without a separator.

Normally, the first lower boiling point fluid, typically an alkane or a refrigerant, will be less dense as a liquid than the higher boiling point, second fluid also as a liquid, typically water. This leads to the lower boiling point liquid normally floating on the upper boiling point liquid, with an upper level outlet being provided for the first liquid, and a lower level output being provided for the second liquid. However, where for instance the lower boiling point liquid is a refrigerant, it can be the more dense. In this case, the liquids and their outlets will be inverted.

The heating means can have one section from a single inlet to a single output to the expander, with the heating means being adapted to heat the two constituent fluids to the same temperature and pressure, whereby the higher boiling point constituent fluid is at least partially or all in vapour state on output to the feed to the expander and the lower boiling point constituent fluid is partially or completely liquid on output to the feed.

Alternatively, the heating means can have two sections, the one for one constituent fluid pumped to one heating means inlet for output to the feed into the expander and the other for the other constituent fluid pumped to another heating means inlet for output into the feed to the expander with the heating means being adapted to heat the two constituent fluids to different temperatures, whereby they are at least partially vaporised on output at substantially the same pressure from the heating means and feed to the feed to the expander. Conveniently in this alternative, the two sections of the heating means are heat exchangers in series for use of a common externally circulated heating medium passed from a first section to a second, the first being arranged to receive the higher boiling point constituent fluid and heat it to a first temperature, and the second being arranged to receive the lower boiling point constituent fluid and heat it to a second, lower temperature.

Again, it is envisaged that the heating means can:

have two sections, the one for one constituent fluid pumped to one heating means inlet for output to the feed into the expander, and the other for the other constituent fluid pumped to another heating means inlet for output into another feed to the expander, and be adapted to heat the two constituent fluids to the different temperature and pressures, whereby at least the lower boiling point constituent fluid is at least partially vaporised on output from the heating means to the feed into a high pressure end of the expander, and the higher boiling point constituent fluid is vapour or liquid at an intermediate pressure feed into the expander.

In the preferred embodiments there is included a heat exchanger acting as a regenerator between the working fluid passing from the expander to the condenser, and the working fluid passing from the condenser to the heating means.

To help understanding of the invention, a specific embodiment thereof will now be described by way of example and with reference to the accompanying drawings, in which.

Figure 1:
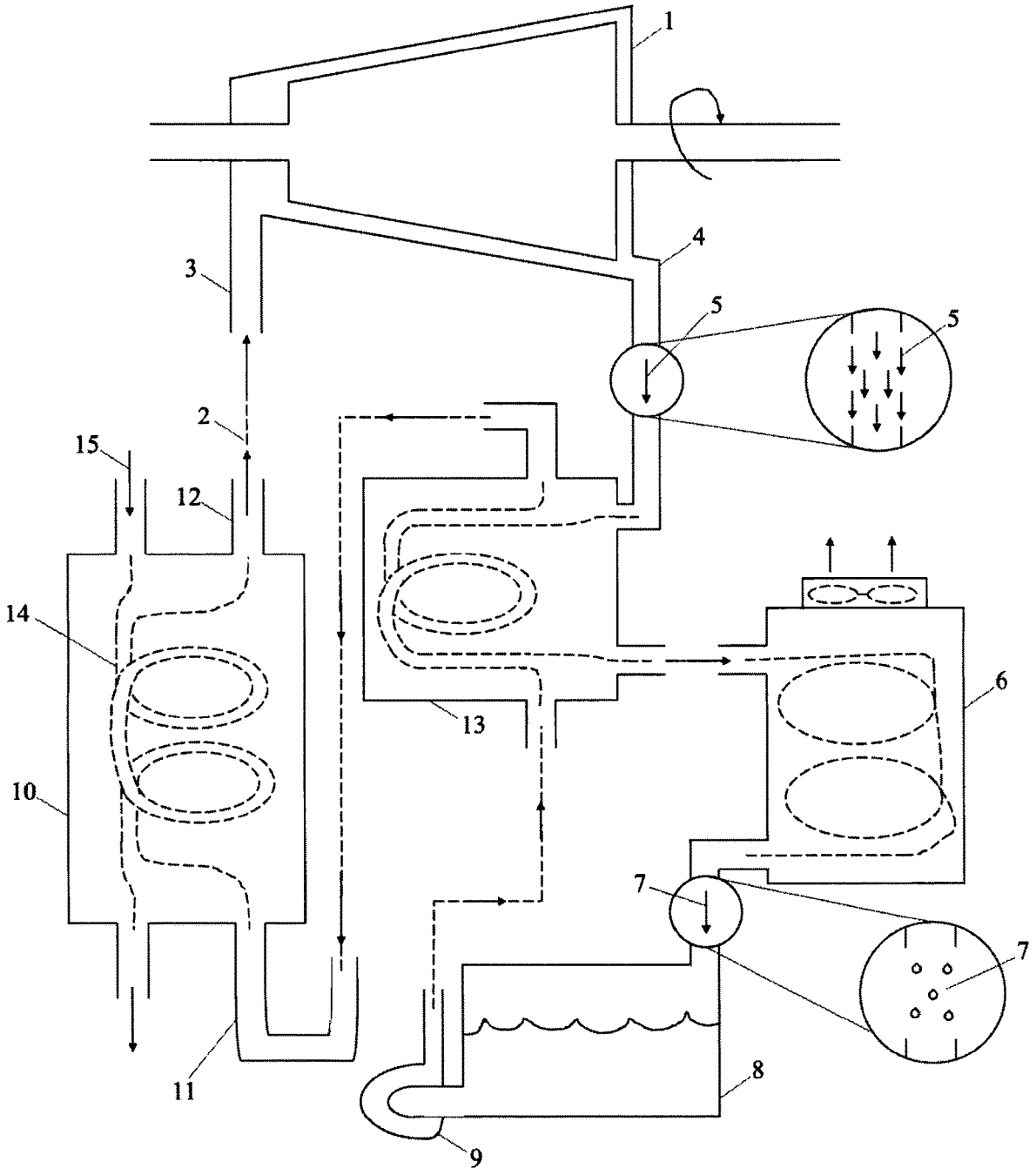
FIG. 1 is a diagrammatic view of a prior Organic Rankine Cycle engine.

Referring to FIG. 1, a prior Organic Rankine Cycle engine has in a closed cycle:

a thermodynamic expander 1 for extracting work from a vaporised organic working fluid 2 fed to a feed 3 for it, and exhausting from an exhaust 4 still as a vapour 5, an air-cooled condenser 6 downstream of the expander for condensing, as condensate 7, expanded vaporised working fluid exhausting from the expander, a liquid tank 8 downstream from the condenser, a pump 9 downstream from the liquid tank for pumping out condensed working fluid 7 from it, and a heater 10 for vaporising the working fluid pumped to it from the pump, and feeding the vaporised working fluid 2 to the expander, the heater having an inlet 11 for the working fluid pumped to it and an output 12 from which the working fluid is fed to the expander, and a regenerator 13 for transferring heat from the exhaust flow 5 to the pumped liquid working fluid upstream of the heater.

Typically, the heater is a heat exchanger 14 with an externally heated heating medium 15 circulated through it in counter-current to the organic working fluid. In so far as the Organic Rankine Cycle engine is known, it will not be described in more detail.

Figure 2:
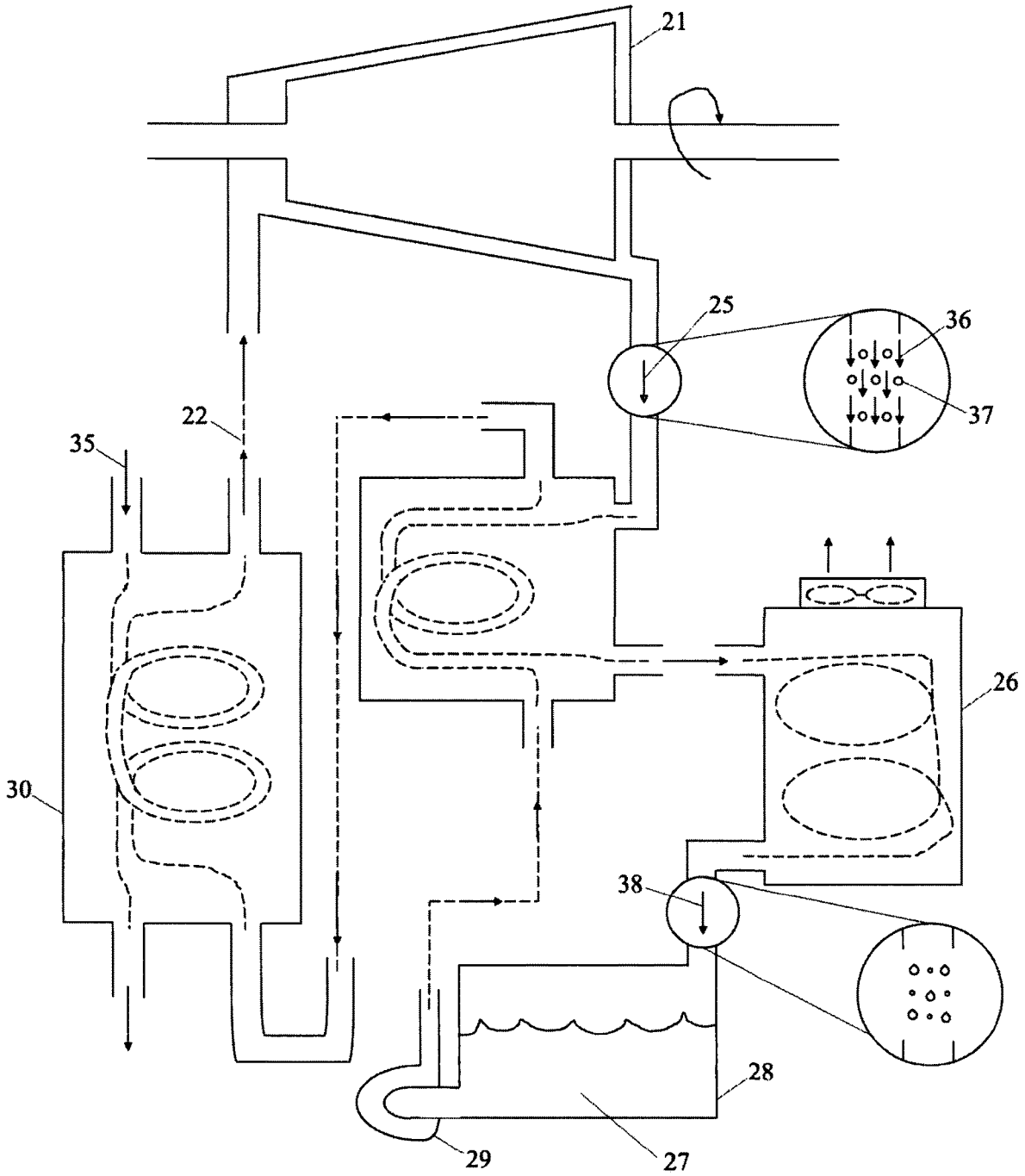
FIG. 2 is a similar view of a thermodynamic engine of the invention.

Turning on to FIG. 2, the engine thereshown is an essentially similar mechanical engine to that of FIG. 1. It differs in accordance with the invention in that the working fluid is not a single alkane nor other single organic liquid. It is a mixture of miscible liquids, typically a mixture of methanol and water. The liquids have different boiling points: methanol: 65° C. and water: 100° C.

With feed to the heater 30 of an external heating medium 35 of over 100° C., such as an air stream heated by the exhaust of an internal combustion engine (not shown), the vaporised feed 22 can be expected to comprise methanol vapour and a mixture of water and water vapour. The exact phase mix of the water between vapour and liquid (in droplet form) will depend upon the temperature to which the feed is heated. On feed into the expander 21, the methanol vapour will expand and cool, giving out work. The water vapour will too. As soon as the water vapour is cooled to 100° C., or somewhat above if the local pressure is significantly above atmospheric, it will tend to condense. In doing so, it will release latent heat of condensation. The release is to the methanol vapour, maintaining its temperature from falling as fast as would otherwise in the absence of the condensing water vapour. Thus, the methanol vapour is maintained energetic and able to produce more work.

With the external heating medium in the region of 100° C., such as from the cooling system of an internal combustion engine, the vaporised feed 22 can be expected to comprise methanol vapour and droplets of water. These still act to maintain the methanol vapour from falling in temperature as fast as they would in the absence of the water. This effect is present in the case of the previous paragraph as well as once all the water vapour has condensed.

These effects, in accordance with the invention, occur as the working fluid passes through the expander 21.

The exhaust 25 from the expander will comprise methanol vapour 36 and water droplets 37. In the condenser 26, the methanol vapour condenses and the flow from it compromises combined methanol and water droplets 38, although for the purposes of illustration, separate droplets of water and methanol are shown in FIG. 2. These collect as condensate 27 in the tank 28. The pump 29 pumps the condensate in the proportion of water and methanol in the engine. Typically, this will be of the order of 1:10. It is expected that between 5% and 15% of water with the balance methanol will work satisfactorily in the engine. Other mixtures of miscible liquids can be expected to be useful, such as ethanol, normal boiling point: 78° C., and water.

Figure 3:
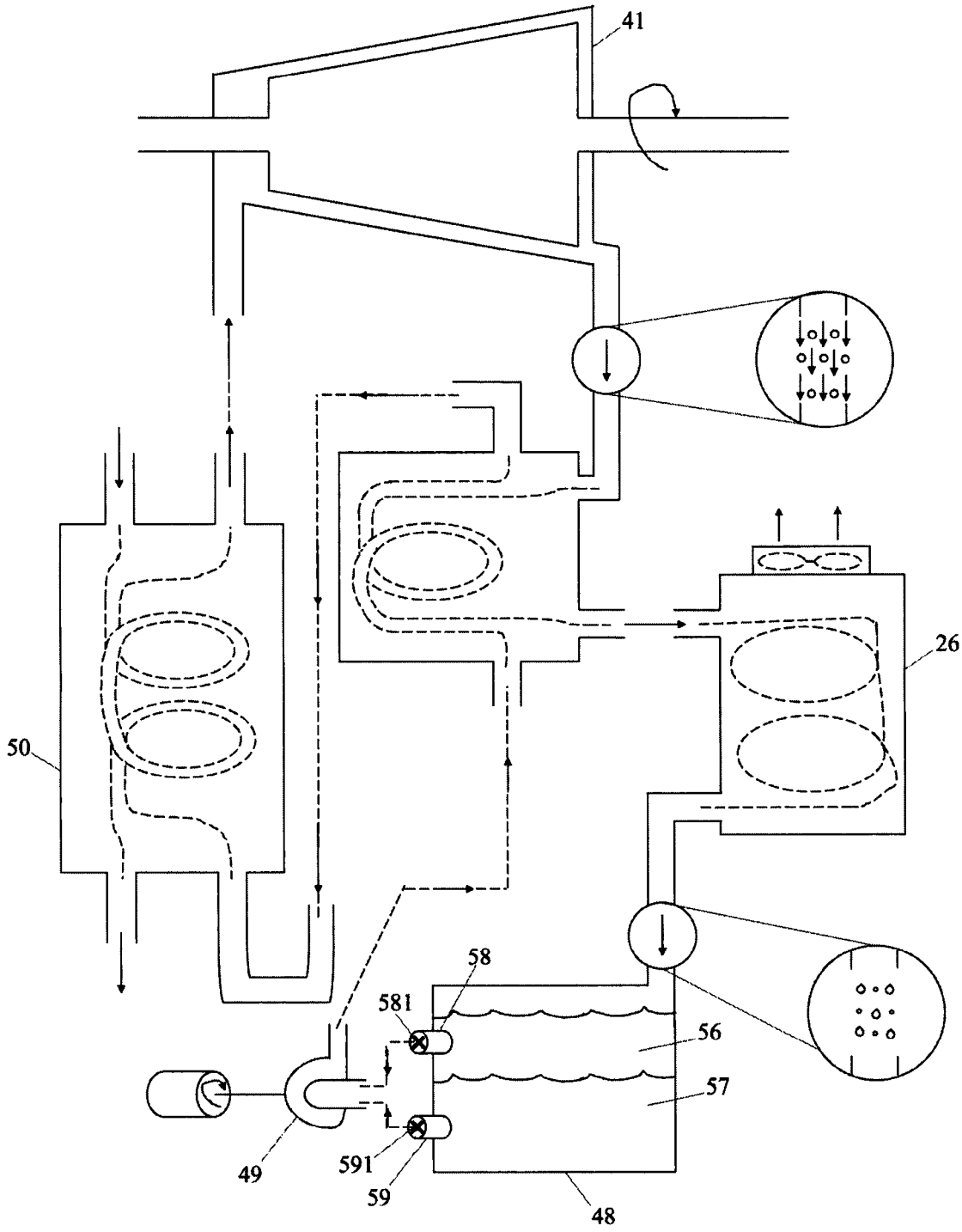
FIG. 3 is a diagrammatic view of another thermodynamic engine of the invention.

Turning now to FIG. 3, the engine thereshown is again similar with two differences which are associated with each other. The working fluid is comprised of 90% pentane and 10% water. In so far as they are immiscible, they form separate layers 56, 57 in the liquid tank 48. The pump 49 is a single pump drawing from two outlets 58, 59 from the liquid tank. The relative flow from the outlets of the two immiscible layers is determined by throttles in the outlets. These can be fixed throttles, such as apertured plates or adjustable throttles in the form of valves 581, 591. These are set so as to draw the pentane and the water in 10:1 ratio similar to their liquid volume ratio in the engine.

The two liquids are fed together to the heater 50. Pentane has a considerably lower boiling point than methanol, i.e. 36° C. As such, it can be expected to exert sufficient pressure at feed from the heater to the expander 41 to maintain the water as liquid, unless the feed temperature is appreciably above 100° C., such as to superheat the water sufficiently for it to vaporise, despite the pentane pressure.

The effect of the invention, i.e. maintaining the lower boiling point pentane energetic by heat transfer from the water, with and without latent heat release, will occur in the expander in the manner of the embodiment of FIG. 2.

Figure 4:
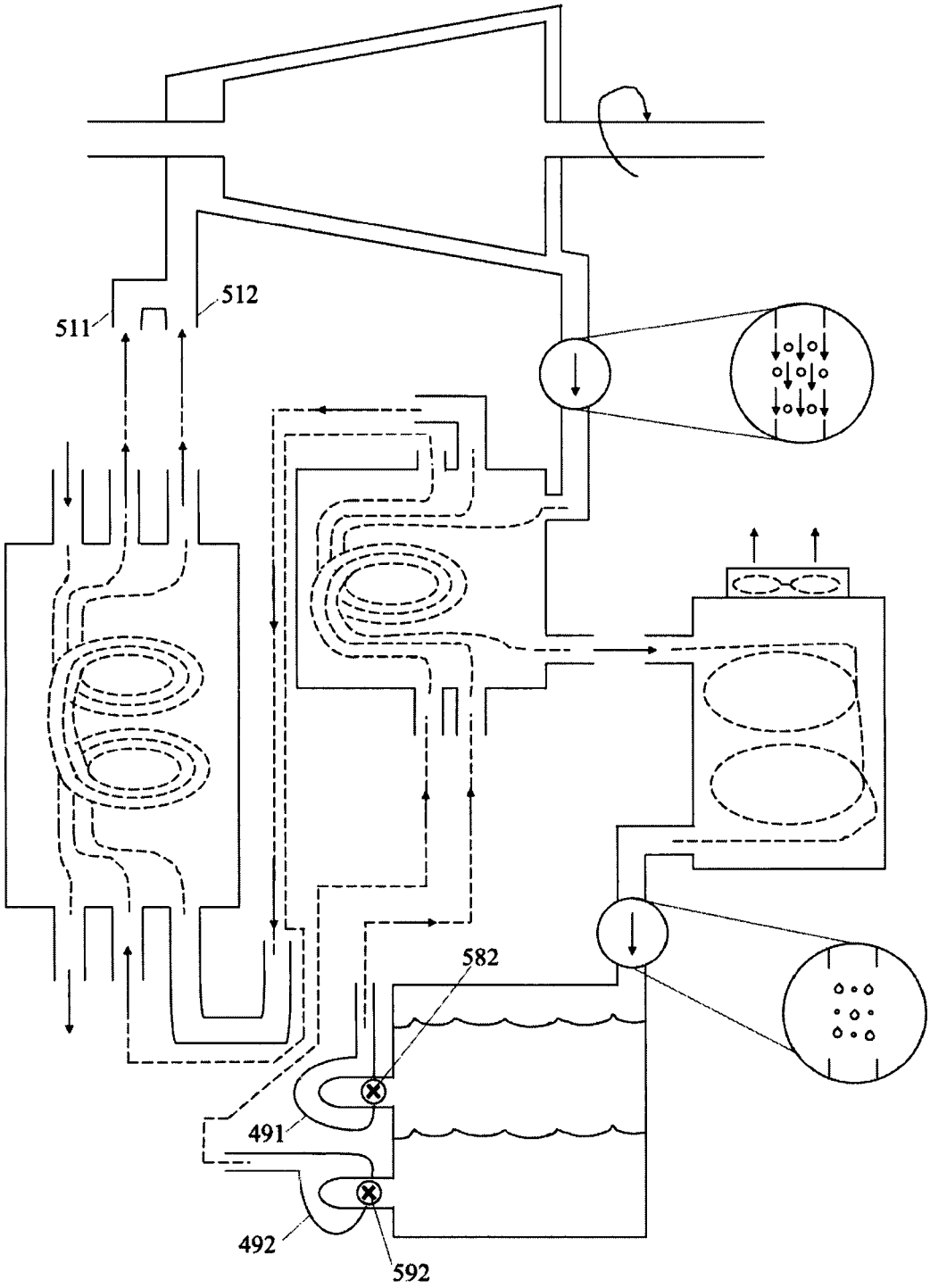
FIG. 4 shows a first variant of the engine of FIG. 3.

In the variant of FIG. 4, the single pump 49 is replaced by two pumps 491, 492 for the pentane and water respectively. The corresponding throttles 582, 592 are shown upstream of the pumps on the liquid tank side, but they could equally be on the downstream side. The inlet 51 to the heater is replaced by two such inlets 511, 512. Equally, the pumps could deliver into a Y piece connected respectively to the two pumps and the one inlet 51.

Figure 5:
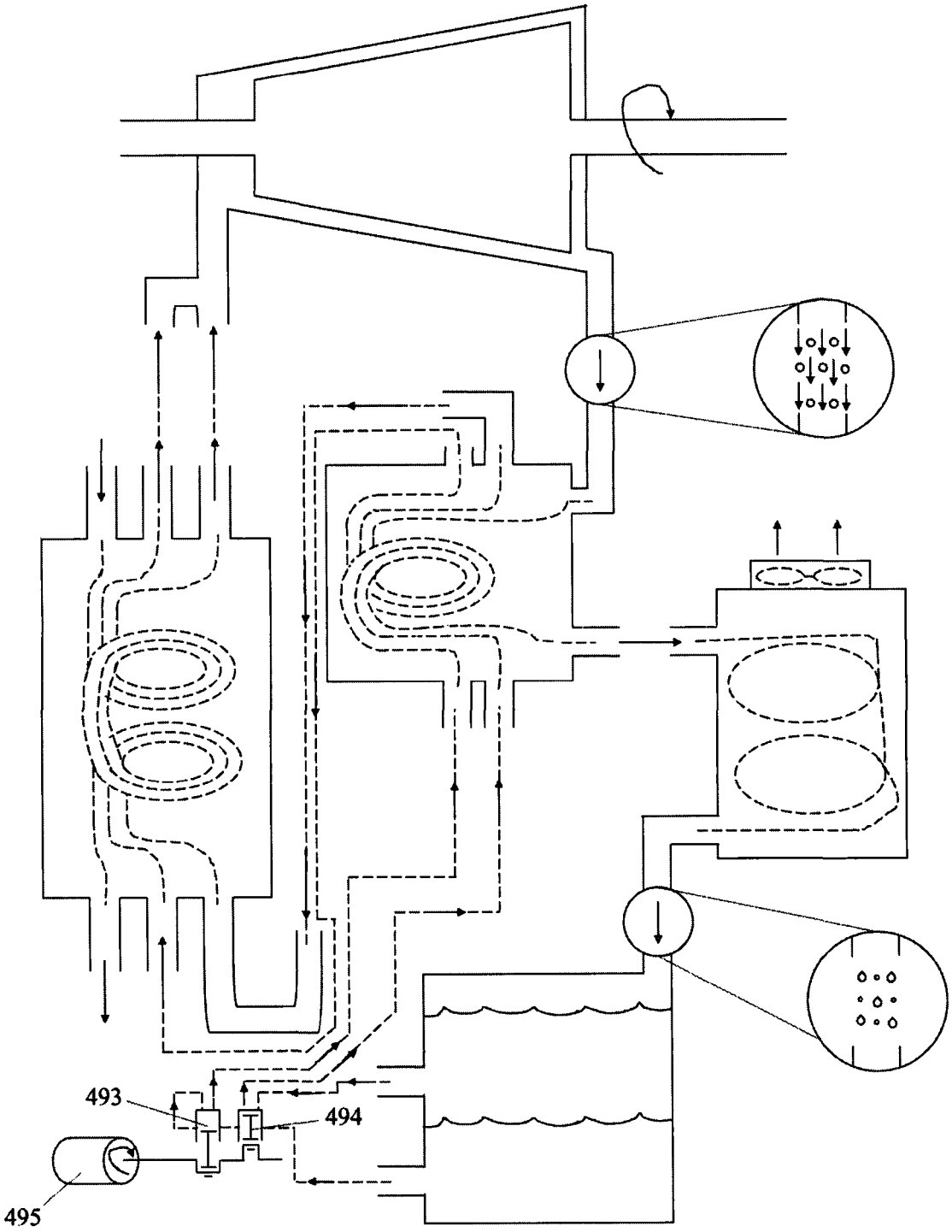
FIG. 5 shows a second variant of the engine of FIG. 3.

Whilst the pumps of FIGS. 3 and 4 are of variable displacement, their delivery is controlled by their throttles. As shown in FIG. 5, the pumps of 493, 494, driven by a common motor 495, are positive displacement pumps with their deliveries being in proportion to their capacities. They require no throttles to provide that their deliveries are in proportion to their displacements.

Figure 6:
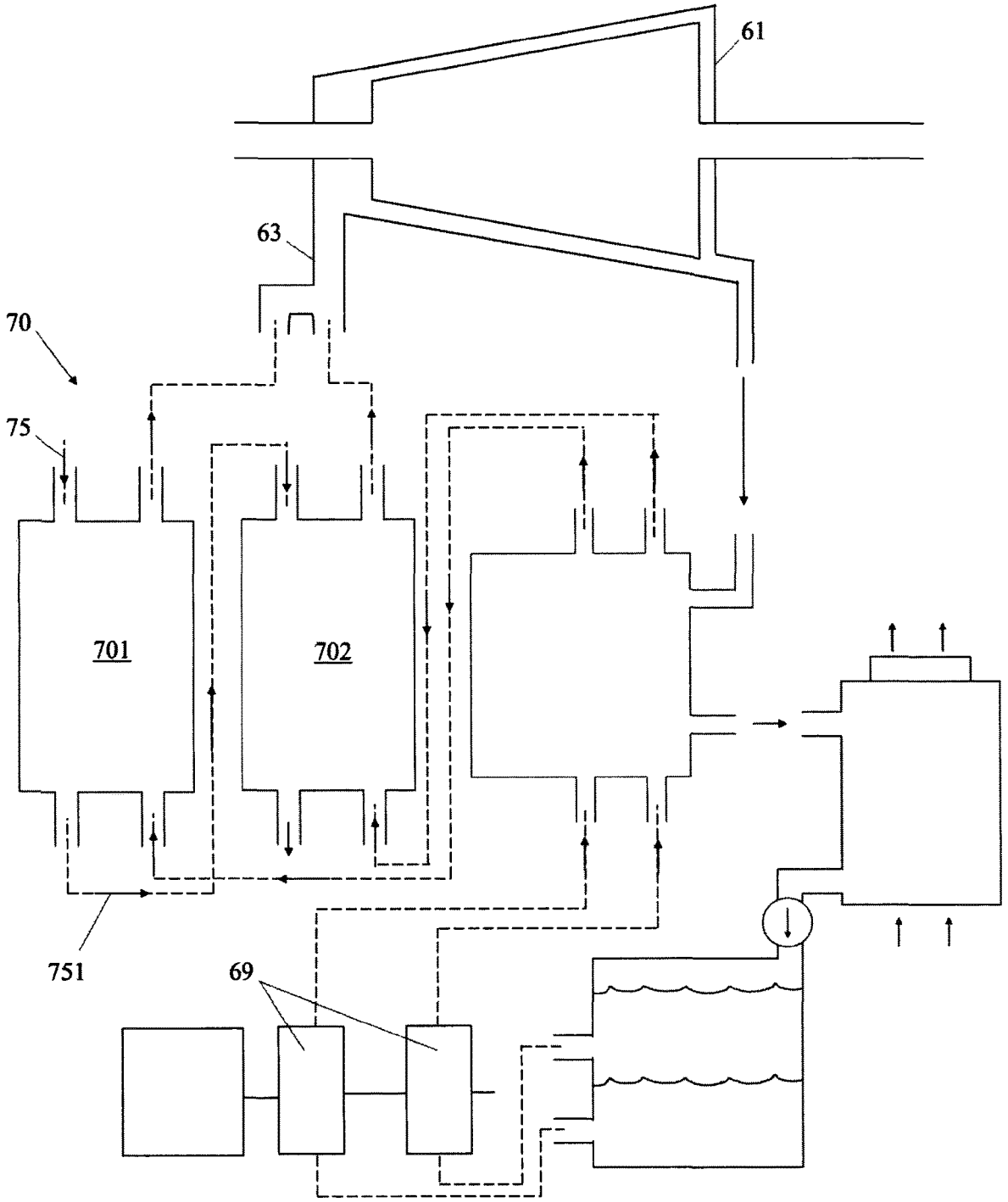
FIG. 6 is similarly a view of a third thermodynamic engine of the invention.

Turning to FIG. 6, an embodiment having a single pump, with two positive-displacement chambers 69 is shown, with a two-part heater 70, with parts 701, 702. The parts are supplied in series with a single heating medium flow 75. This enters part 701 at elevated temperature and heats the higher boiling point constituent of the working fluid e.g. water, leaving to feed the expander 61 via the single feed 63. This is then heated to close to the input temperature of the heating medium. The flow 751 from the part 701 is reduced in temperature and enters the second part, heating the lower boiling point constituent, e.g. pentane, to its somewhat reduced temperature. This constituent is also fed to the single feed 63.

In thus heating the two constituents of the working fluid to different temperatures, but the same pressure as they enter the expander together, the higher boiling point constituent is vaporised and not pressurised to remain liquid, whilst the lower boiling point constituent is still vaporised. In the expander, the higher boiling point constituent can expand giving useful work and heat the lower boiling point constituent, whilst also providing useful work. As the higher boiling point constituent is cooled and condenses it gives energy to the lower boiling point constituent allowing it to produce work in accordance with the invention, as described above.

Figure 7:
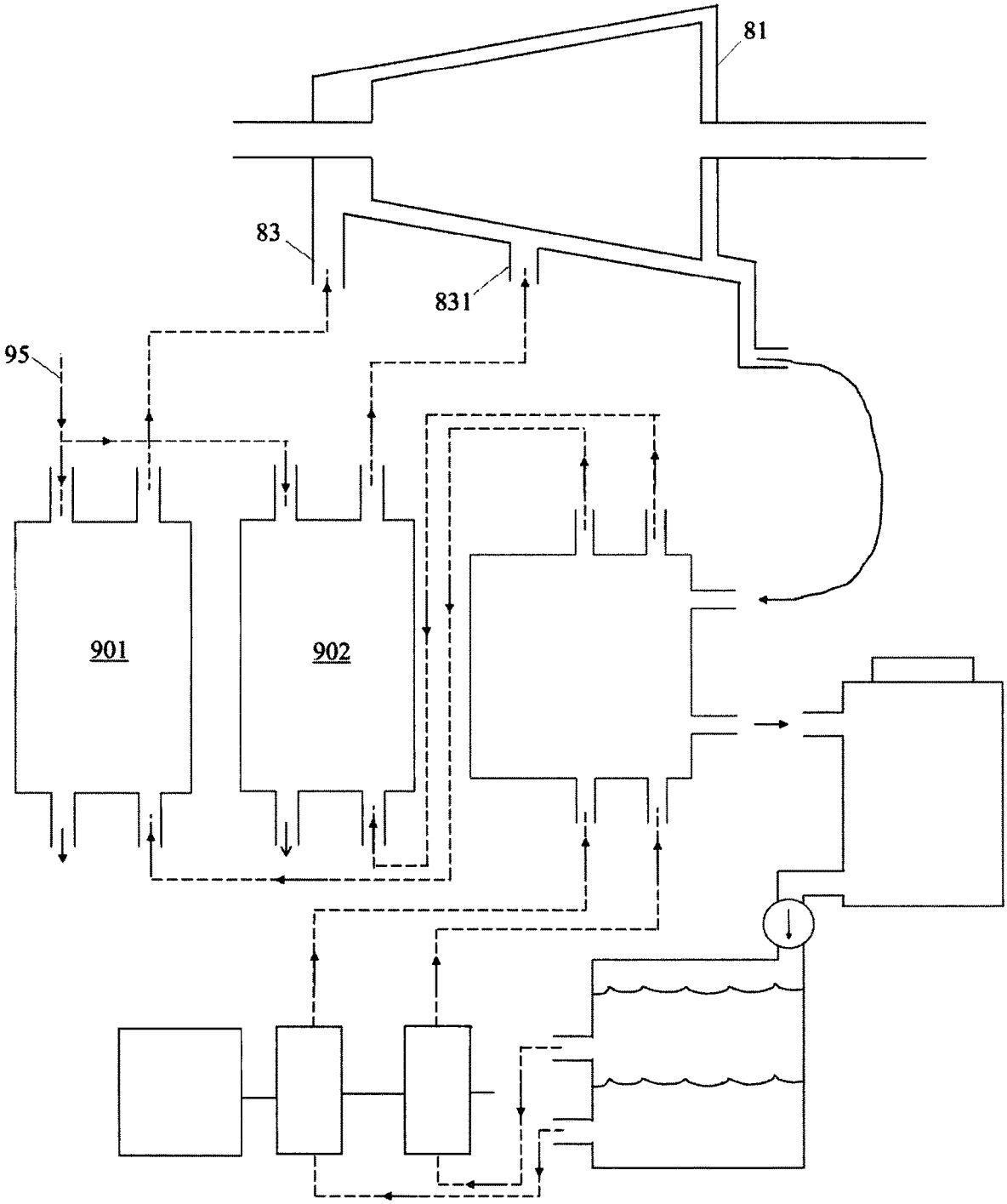
FIG. 7 is a diagram of a fourth engine of the invention.

The embodiment of FIG. 7 is different again, in that there are two parts 901, 902 of the heater, supplied in parallel with the same heating medium flow. Thus, the two working fluid constituents are heated to the same temperature. The lower boiling point one has its pressure raised over the higher boiling point one, essentially because it is heated through a greater temperature difference above its boiling point. This higher pressurised constituent is fed to the high-pressure feed 83 of the expander. The second lower pressurised constituent is fed to an intermediate point 831 in the expander, where the higher pressurised constituent has expanded to a corresponding lower pressure. Introduced here, the lower boiling point constituent expands and transfers heat in the manner described above.

Figure 8:
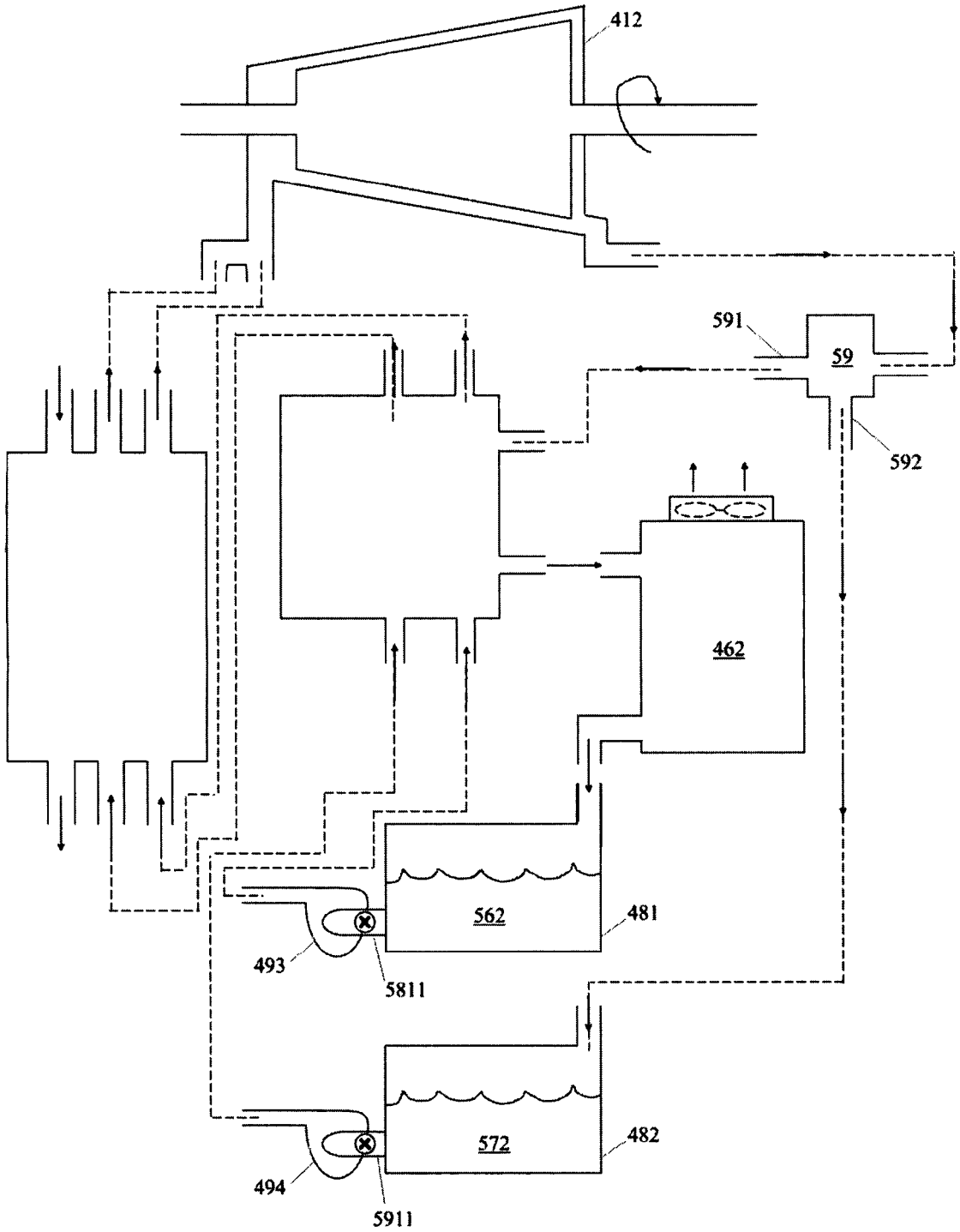
FIG. 8 is a variant of the engine of FIG. 4.

The invention is not intended to be restricted to the details of the above described embodiment. For instance, as shown in FIG. 8, in a variant of the engine of FIG. 4, a separator 59 is provided downstream of the expander 412 and upstream of the condenser 462, for separating out the higher boiling point constituent liquid 572. This is passed via a separator outlet 592 directly to a separate tank 482, whence it can be pumped back to the heater from an outlet 5911 in the separate tank by the pump 494. This arrangement reduces the amount of heat required to be removed in the condenser. Conveniently, the separator is a cyclone separator. The lower boiling point constituent liquid 562 is passed from the condenser 462 to a condensate tank 481, for pumping via outlet 5811 by pump 493.

It should be noted that the liquid tank receiving flow of the two liquids from the condenser is itself a separator, in that it allows the liquids to separate in it.

A point not commented on above is that both fluids pass through the heater together in the same duct in the embodiments of FIGS. 2 and 3, whilst separate ducts are shown in the other embodiments. This is necessary in the embodiments of FIGS. 6 and 7, but not necessarily so in the engines of FIGS. 4 and 5, where single heating ducts are possible in the respective heaters.

The heater may be provided with its heat by means other than liquid or gaseous flow. For instance, it might be heated directly by conduction, as by clamping to an internal combustion engine exhaust. Alternatively, it might be heated directly by radiation as by close proximity with an exhaust. Other sources of waste heat can be used for powering the engine such as solar energy.

The constituents of the working fluids can vary. For instance, the miscible water and methanol or ethanol can be replaced by pentane and isopropyl alcohol, with respective ambient pressure boiling points of 36° C. and 97° C.

The invention claimed is:

1. An externally heated thermodynamic engine having a closed working-fluid circuit, the engine comprising:

a working fluid including at least two different boiling point constituent fluids, a thermodynamic expander for extracting work from vaporised working fluid fed to a feed for it, a condenser downstream of the expander for condensing expanded vaporised working fluid exhausting from the expander, a liquid tank downstream from the condenser, pump means downstream from the liquid tank for pumping out condensed working fluid from it, and means for heating and at least partially vaporising working fluid pumped to it from the pump and feeding the heated working fluid to the expander, the heating means having at least one inlet for working fluid pumped to it and at least one output from which the working fluid is fed to the expander;

wherein:

the pump means is adapted to pump from the liquid tank to the heating means both the different boiling point constituent fluids in a determined ratio as liquids and the relative boiling points of the different boiling point constituent fluids are such that in use:

on feeding of the working fluid to the expander, it is in at least partially vaporised state, vapour and/or liquid of the higher boiling point liquid releases latent heat energy in the expander to vapour of the lower boiling point constituent fluid for production of work in the expander and the higher boiling point liquid is liquid on exit from exhaust of the thermodynamic expander.

2. An engine as claimed in claim 1, wherein the pump is a single pump arranged in an arrangement:

to draw from a single outlet from the liquid tank and to pump to a single inlet to the heating means, the arrangement being suitable for the different boiling point constituent fluids being miscible as liquids and pumped to the heating means in proportion to their constituent proportions in the engine at the determined ratio.

3. An engine as claimed in claim 1, wherein the pump is a single pump arranged:

to pump to one or more inlets to the heating means and to draw from two outlets from the liquid tank or two respective liquid tanks:

the outlets or lines from them to the pump having respective throttles, the throttles being such that the different boiling point constituent fluids are pumped as liquids in proportion to the determined ratio.

4. An engine as claimed in claim 1, wherein the pump is a two-chamber pump or a pair of pumps arranged:

to pump to one or more inlets to the heating means, and to draw from two outlets from the liquid tank or two respective liquid tanks:

the outlets or lines from them to the pump, or lines from the pumps to the or each inlet, or each inlet where two are provided have respective throttles, the throttles being such that the different boiling point constituent fluids are pumped as liquids in proportion to the determined ratio.

5. An engine as claimed in claim 3, wherein the throttles are fixed for fixing the determined ratio.

6. An engine as claimed in claim 3, wherein the throttles are adjustable for adjusting the determined ratio.

7. An engine as claimed in claim 1, wherein the pump is a two-chamber pump, or a pair of pumps, arranged:

to pump to one or more inlets to the heating means, to draw from two outlets from the liquid tank or two respective liquid tanks, and to pump with positive displacement in proportion to the determined ratio.

8. An engine as claimed in claim 3, wherein the closed cycle is such that the higher boiling point constituent fluid is passed through the condenser to a single liquid tank for it, and the condensed lower boiling point fluid from the condenser, the two outlets being arranged in the single tank at different levels in the liquid tanks to enable the pump to draw the different boiling point constituent fluids as liquids from the tank via the respective outlets.

9. An engine as claimed in claim 3, including:

a separator, preferably a cyclone separator, is provided in the closed cycle upstream of the condenser, a first said liquid tank for receiving condensed liquid of the lower boiling point constituent fluid, and a second said liquid tank for receiving separated liquid of the higher boiling point constituent fluid:

the respective tanks having the two outlets for the respective liquids.

10. An engine as claimed in claim 3, including:

a separator, preferably a cyclone separator, is provided in the closed cycle upstream of the condenser, and a single said liquid tank for receiving condensed liquid of the lower boiling point constituent fluid and separated liquid of the higher boiling point constituent fluid, with the two outlets being arranged in the single tank at different levels in the liquid tanks to enable the pump to draw the different boiling point constituent fluids from the tank via the respective outlets.

11. An engine as claimed in claim 1, wherein:

the heating means has one section from a single inlet to a single output to the expander, and the heating means is adapted to heat the two constituent fluids to the same temperature and pressure, whereby the lower boiling point constituent fluid is at least partially or all in vapour state on output to the feed to the expander and the higher boiling point constituent fluid is all or partially vaporised or completely liquid on output to the feed.

12. An engine as claimed in claim 4, wherein:

the heating means has two sections, the one for one constituent fluid pumped to one heating means inlet for output to the feed into the expander, and the other for the other constituent fluid pumped to another heating means inlet for output into the feed to the expander, and the heating means is adapted to heat the two constituent fluids to different temperatures, whereby they are at least partially vaporised on output at substantially the same pressure from the heating means and feed to the feed to the expander.

13. An engine as claimed in claim 8, wherein the two sections of the heating means are heat exchangers in series for use of a common externally circulated heating medium passed from a first section to a second, the first being arranged to receive the higher boiling point constituent fluid and heat it to a first temperature, and the second being arranged to receive the lower boiling point constituent fluid and heat it to a second, lower temperature.

14. An engine as claimed in claim 4 wherein:

the heating means has two sections, the one for one constituent fluid pumped to one heating means inlet for output to the feed into the expander, and the other for the other constituent fluid pumped to another heating means inlet for output into another feed to the expander, and the heating means is adapted to heat the two constituent fluids to the different temperature and pressures, whereby at least the lower boiling point constituent fluid is at least partially vaporised on output from the heating means to the feed into a high pressure end of the expander, and the higher boiling point constituent liquid is vaporised or liquid at an intermediate pressure feed into the expander.

15. An engine as claimed in claim 1, including a heat exchanger acting as a regenerator between the working fluid passing from the expander to the condenser and the working fluid passing from the condenser to the heating means.

16. A method of operating an externally heated thermodynamic engine having a closed working-fluid circuit, the engine comprising:

a thermodynamic expander for extracting work from vaporised working fluid fed to a feed for it, a condenser downstream of the expander for condensing expanded vaporised working fluid exhausting from the expander, a liquid tank downstream from the condenser, pump means downstream from the liquid tank for pumping out condensed working fluid from it, and means for heating and at least partially vaporising working fluid pumped to it from the pump and feeding the heated working fluid to the expander, the heating means having at least one inlet for working fluid pumped to it and at least one output from which the working fluid is fed to the expander;

the engine being adapted and arranged for operation with a working fluid including at least two different boiling point constituent fluids and the pump means being adapted to pump from the liquid tank to the heating means both the different boiling point constituent fluids in a determined ratio as liquids;

wherein the method includes the operating steps of:

the working fluid is fed to the expander in at least partially vaporised state, vapour and/or liquid of the higher boiling point liquid is caused to release heat energy in the expander to vapour of the lower boiling point constituent fluid for production of work in the expander and the higher boiling point liquid is caused to be liquid on exit from exhaust of the thermodynamic expander.

* * * * *